US005437106A

United States Patent [19]

Pardoe

[11] Patent Number: 5,437,106

[45] Date of Patent: Aug. 1, 1995

[54] CLOTHES DRYER UTILIZING AIR CONDITIONING WASTE HEAT

[76] Inventor: Fred W. Pardoe, 13700 Windlo Cir., Ocean Springs, Miss. 39564

[21] Appl. No.: 985,025

[22] Filed: Feb. 19, 1993

[51] Int. Cl.[6] ..... F26B 19/00

[52] U.S. Cl. ..... 34/90; 34/239

[58] Field of Search ..... 34/239, 240, 35, 86, 34/90, 91, 19; 248/218.4

[56] References Cited

U.S. PATENT DOCUMENTS 3,197,886 8/1965 Brame et al. ..... 34/90
3,417,481 12/1968 Rumsey, Jr. ..... 34/90
4,086,709 5/1978 Jackson ..... 34/90
4,429,928 2/1984 Sullivan ..... 34/239
4,873,773 10/1989 Canonge ..... 34/90

*Primary Examiner*—Denise Gromada

[57] ABSTRACT

This device consists of a clothes rack that attaches to the residential Air Conditioning Condenser Unit and is readily portable, rotates for easy loading, and embodies an adjustable mounting base that clamps or fastens to the existing Condenser Unit. The pre-heated air from the Condenser Unit, which is approximately One Hundred and Fifteen Degrees Farenheit and Thirty Percent Relative Humidity, is circulated through the wet garments, thus utilizing the waste heat as the drying agent.

1 Claim, 2 Drawing Sheets

CLOTHES DRYER UTILIZING AIR CONDITIONING WASTE HEAT

SUMMARY OF INVENTION

The purpose of this invention is to utilize the waste heat from Condenser Units of Air Conditioner Units by providing an adjustable mounting rack with a folding portable system of Clothes Lines.

BRIEF DESCRIPTION OF THE DRAWINGS

The Plan and Elevation Views indicate the general arrangement of the device. Each part has been assigned a piece number. These numbers, where a detail is necessary, are reflected in the sheet of details.

DETAILED DESCRIPTION

Figure 1:
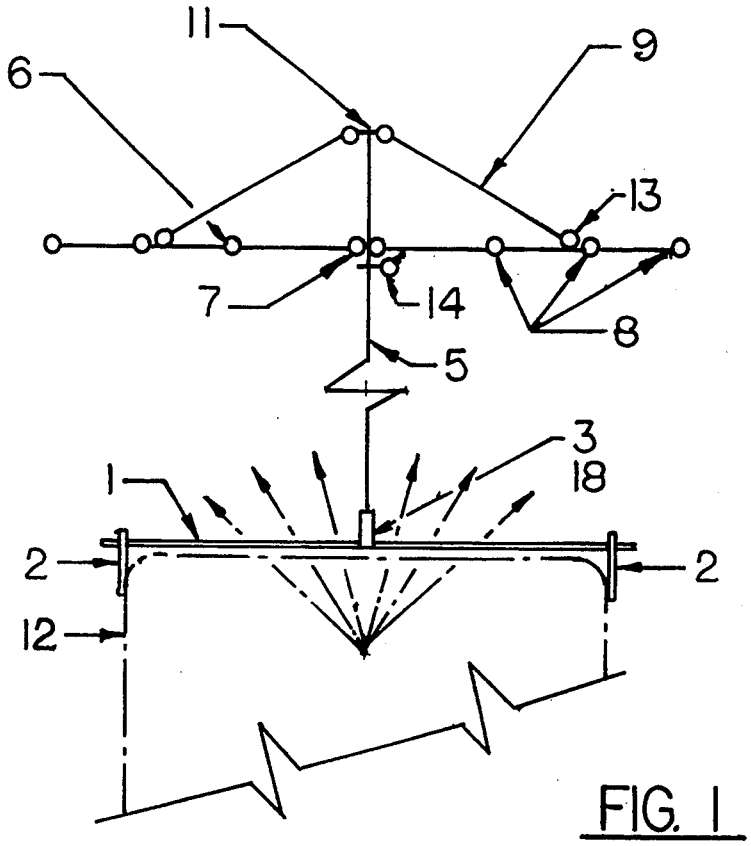
FIG 1 is a side elevation.
Figure 2:
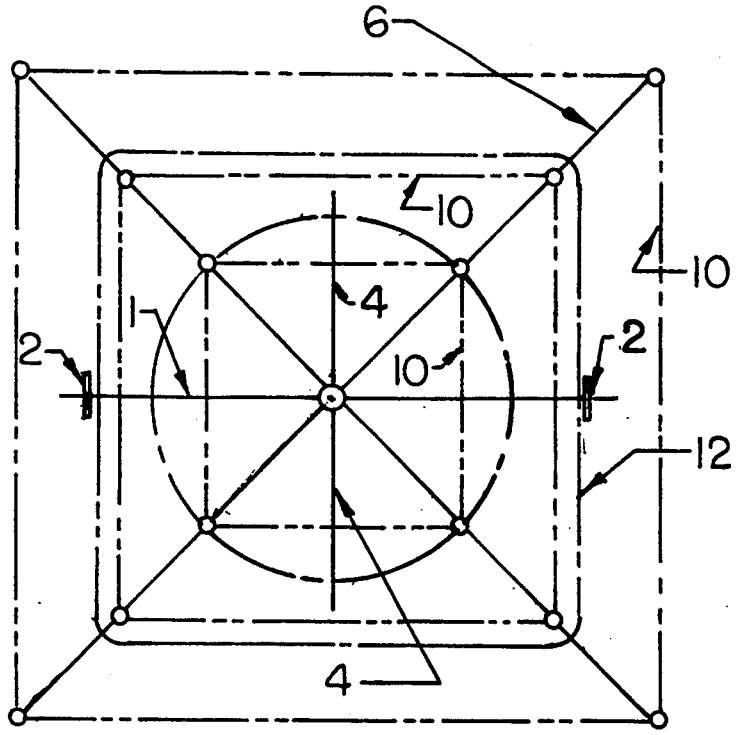
FIG. 2 is a plan view of FIG. 1.
Figure 3A:
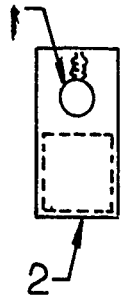
FIGS. 3–8 are details of the Clothes Drying Rack and Supports. (See Appendix, Material List)
Figure 3B:
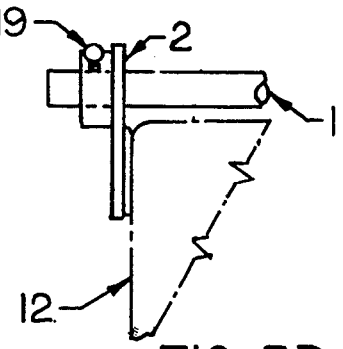
Figure 4:
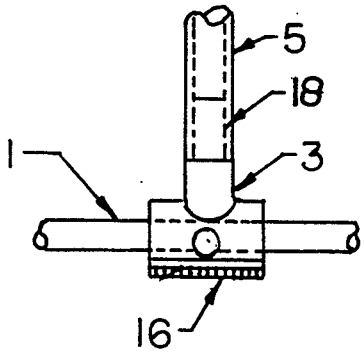
Figure 5:
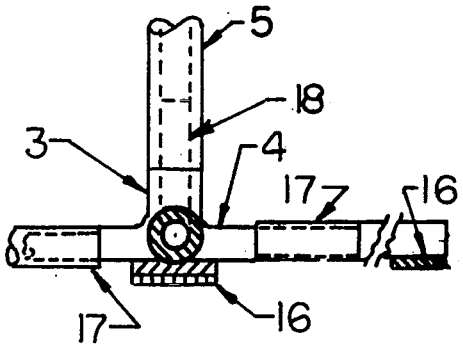
Figure 8:
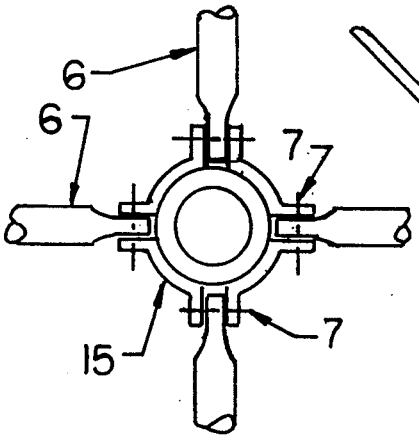
Figure 6:
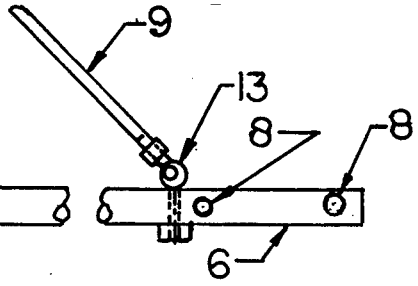
Figure 7A:
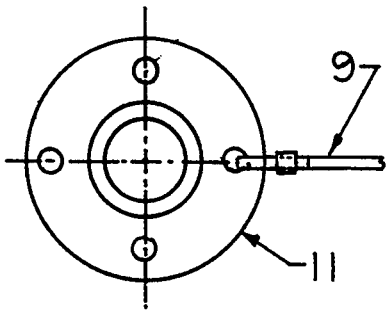
Figure 7B:
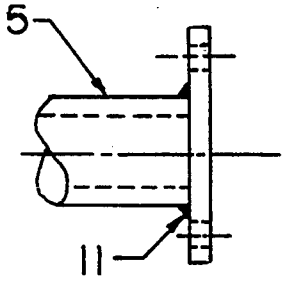

This apparatus consists of an adjustable mounting rack, Parts 1,2,3,4,16,17,and 18, so constructed to permit it to be clamped to the Air Conditioning Condenser Unit, Part 12, of residential cooling systems. There shall be a system of clotheslines, Parts 8 and 10, mounted on a folding portable rack that shall rotate for easy loading.

The mounting rack is so designed to permit the Movable Post Socket, Part 3, to be located off-center, if necessary, to avoid interference with surrounding structures.

The Clothesline Rack Vertical Pole, Part 5, shall be a "slip fit" over part 18 to allow easy rotation for loading and to allow removing when not in use. The Clothesline Rack shall fold by the removal of the Retaining Pin, Part 14, located in the Vertical Pole, Part 5.

The Cover Plate, Part 11, shall be welded to the Vertical Pole, Part 5. This Cover Plate, Part 11, shall have four holes at 90 degrees each, to accomodate the Support Wires, Part 9. The Base Assembly, Part 3, shall be constructed by the use of a standard Aluminum Pipe Tee. It shall be sized to permit the Clamping Rod, Part 1, to slide through freely. There shall be a Short Nipple, Part 18, facing upward and sized to accomodate the Vertical Pole, Part 5. There shall be two Extensions, Part 4, welded to each side of the Tee, Part 3, at 90 degrees to the Clamping Rod, Part 1, to accomodate the Adjustable Extention Rods, Part 17. Each Adjustable Extention Rod, Part 17, shall have a Support Plate and Pad, Part 16, welded to the other end of the Extention Rod, to prevent damage and vibration.

The Clamping Plates and Padding, Part 2, shall have a hole in the upper part that is a close fit for the Clamping Rod, Part 1. Clamping Rings with Locking Screws, Part 19, sized to fit the Clamping Rod, Part 1, shall be provided to prevent the Clamping Plates, Part 2, from expanding.

Eye Bolts, Part 13, to accomodate the Support Wires, Part 9, shall be located in each Clothesline Beam, Part 6. Smooth Clothesline Eyelet penetrations, Part 8, through Clothesline Beams, Part 6 shall be provided for Clotheslines, Part 10. There shall be a sliding Hinge Arrangement consisting of four Flat Bar Brackets, Part 15, and four Bolt Hinges, Part 7. This assembly shall be a loose fit around the Removable Post, Part 5. There shall be a Pin, Part 14, inserted through the Removable Post, Part 5, to retain the Hinge Assembly, Parts 15 and 7, and the Clothesline Beams, Part 6, at 90 degrees to the Removable Post, Part 5.

The above description is depicted by the General Arrangement and Detail Drawings attached.

1CLAMPING ROD
2ADJUSTABLE CLAMPS AND PADS
3MOVABLE POST SOCKET
4BALANCING BEAMS
5REMOVABLE POST
6CLOTHES LINE BEAMS
7BOLT HINGES
8CLOTHES LINE EYELETS
9FLEXIBLE WIRE BEAM SUPPORT
10CLOTHES LINES
11COVER PLATE
12EXISTING A.C. CONDENSER UNIT
13EYE BOLTS
14REMOVABLE PIN
15FLAT BAR BRACKETS
16SUPPORT PLATE AND PAD
17ADJUSTABLE EXTENSION RODS
18SHORT NIPPLE
19CLAMPING RINGS WITH LOCKING SCREWS

What I claim is:

1. A clothes drying rack utilizing air conditioning waste heat, comprising:

a residential condensing unit and a collapsible drying rack removably clamped above the top of said condenser unit in the waste heat air stream:

said drying rack further comprises:

a main vertical center support post mounted in a movable post socket to the condenser unit, collapsible and removable clothes line beams hinged to a sliding fitting which fitting is mounted around said center support post, flexible wire beam supports attached, at one end, to a cover plate fastened to the top of said center support post and, at an opposite end, to said clothes line beams, clothes line eyelets along the length of each clothes line beam for threading of clothes line in a square shape for hanging garments over the waste heat air stream for drying.

* * * * *